US007497200B2

(12) United States Patent
Golden et al.

(10) Patent No.: US 7,497,200 B2
(45) Date of Patent: Mar. 3, 2009

(54) CONTINUOUS THROTTLE REGULATION DEVICE

(76) Inventors: Terrance Golden, 1614 Electric St., Dunmore, PA (US) 18509-2104; Mark Ayers, 1005 Spruce Dr., Clarks Summit, PA (US) 18411; John A. Hynak, RR #2 Boxx 2092, Moscow, PA (US) 18444

( * ) Notice: Subject to any disclaimer, the term of this patent is extended or adjusted under 35 U.S.C. 154(b) by 101 days.

(21) Appl. No.: 11/788,320

(22) Filed: Apr. 19, 2007

(65) Prior Publication Data

US 2007/0246011 A1 Oct. 25, 2007

Related U.S. Application Data

(60) Provisional application No. 60/793,527, filed on Apr. 19, 2006.

(51) Int. Cl.
*F02D 17/04* (2006.01)

(52) U.S. Cl. ..... 123/397; 123/399; 123/339.15; 123/198 DB; 123/198 DC

(58) Field of Classification Search ..... 123/350, 123/361, 397, 399, 399.15, 198 DB, 198 DC
See application file for complete search history.

(56) References Cited

U.S. PATENT DOCUMENTS 4,336,778 A 6/1982 Howard
4,862,850 A 9/1989 Janisch et al.
6,073,610 A 6/2000 Matsumoto et al.
6,651,608 B2 * 11/2003 Steffen ..... 123/198 D
6,796,288 B2 * 9/2004 Franke et al. ..... 123/406.35
7,191,758 B2 * 3/2007 Umezu ..... 123/397
7,363,907 B2 * 4/2008 Norrman ..... 123/397

* cited by examiner

*Primary Examiner*—Erick Solis
(74) *Attorney, Agent, or Firm*—ZALE Patent Law

(57) ABSTRACT

A continuous throttle regulation device employs a motor throttle body located proximate to a motor or engine, and an accelerator pedal located remote from the motor or engine. A return switch (RS) is responsive to the motor throttle body, and a pressure sensitive switch (PSS) is responsive to the accelerator pedal position. Power is passed through both switches then to a critical electronic element required to run the motor, such as a distributor. Therefore, when both switches are open, power to the critical element is interrupted, slowing or stopping the motor. When both switches are closed, the power is restored to the ignition causing the motor to operate. Therefore, the system may engage and disengage automatically and intermittently numerous times in a short period of time, thereby safely limiting motor speed, while restoring power in a split second to keep the motor running and operational. This technology may also be applied to gasoline, diesel, and electric motors to regulate their operation.

13 Claims, 2 Drawing Sheets

CONTINUOUS THROTTLE REGULATION DEVICE

CROSS REFERENCE TO RELATED APPLICATIONS

This application claims priority from, is related to, and incorporates the content of U.S. Provisional Patent Application 60/793,527, filed Apr. 19, 2006, having the same inventorship.

BACKGROUND OF THE INVENTION

1. Field of the Invention

The present invention relates to an automated system for interactively limiting the speed of a motor or engine.

2. Discussion of Related Art

Several prior art systems are known for limiting the operation of a gasoline, diesel, electric or hybrid engine or motor (collectively referred to as "motors") to prevent damage or injury. One such patent is designed to be used on snowmobile engines. It determines if the throttle and/or its linkage has stuck in the open position. If so it triggers a latch switch which grounds out the power to the spark plugs. Once this is tripped, it requires a user to manually re-set the system to allow the system to operate again.

There are also similar systems which cut off the fuel supply to the engine, again shutting off the engine until it can be reset.

Systems such as these are useful in auto racing. For example, recently, two drivers were killed in a stock car race due to a throttle sticking in the open position. A device such as that described above would be able to cut out the throttle; however, the engine will not be able to operate until the device is re-set.

In a racing environment, there is considerable shaking, vibration and other distractions that a driver would not easily be able to quickly re-set the engine to continue running after it was disabled by the safety system such as the one described above.

Since a second can make the difference between a win and loss, it is important that these safety devices operate efficiently with minimal time delay.

Also, these devices assume that once a throttle sticks, that it is permanently stuck until it can be repaired. In reality, it is possible that a sticky throttle will still operate, but slower than one that is in proper working order. The prior art designs do not take this fact into account, and therefore are not effective in a racing situation, possibly where these devices are most needed.

Currently, there is a need for a motor or engine speed safety device, which allows rapid reset and reduces speed only when required.

SUMMARY OF THE INVENTION

One embodiment of the present invention is a safety control system in a vehicle having an electric power source and a motor for accelerating said vehicle, the motor having a throttle body which controls the speed of the motor, the motor only operating when electric power is provided to it, the safety control system comprising:

a. an accelerator pedal which operates a throttle body thereby controlling the speed of a motor;

b. a pressure sensitive switch (PSS) on the pedal connected between said electric power source and said motor, which is in the 'on' position when the pedal is being pressed and in an 'off' position when the pedal is not being pressed, the PSS causing electric power to flow to the motor when it is in the 'on' position, allowing the motor to operate when the pedal is being pressed;

c. a return switch (RS) on said throttle body, being in an 'on' position when the throttle body is in an idle position and in an 'off' position when the throttle body is in a position which is not the idle position, the RS providing electric power to the motor when in the 'on' position thereby allowing the motor to operate when the throttle body is in the idle position.

Another embodiment of the present invention is a speed regulation system for intermittently reducing the speed of a motor, engine or other propulsion device propelling a vehicle ("motors") in an error condition, the vehicle having an electric power source and a motor, the motor operating when power from the power source is provided to the motor, the motor speed being responsive to a throttle body causing the motor to run at an idle speed (or coasting speed for an electric motor) when the throttle body is in a resting position, and at a running speed when the throttle body is in a running position, the vehicle also having a remote accelerator placing the throttle body in a running position when pressed, and a return device for urging the throttle body to its resting position when the accelerator is not pressed, the regulation device comprising:

a. a pressure sensitive switch (PSS) having an input which is connected to the power source, and an output coupled to the motor, the PSS being responsive to the accelerator pedal such that if the PSS is in a 'closed' position when the accelerator is pressed, the PSS thereby acting to provide power to the motor coupled to the output of the PSS, and the PSS is in an 'open' position when the accelerator pedal is not pressed, thereby not providing power to its output connected to the motor;

b. a return switch (RS) having an input which is connected to the power source, the RS being responsive to the throttle body such that the RS is in a 'closed' position when the speed control is in its resting position, the RS thereby acting to provide power to the motor coupled to its output, and the RS is in an 'open' position when the speed control is in its running position thereby acting to restrict electric power from reaching the motor.

The present invention may also be embodied in a vehicle having an electric power source and a motor for accelerating said vehicle, having accelerator pedal which operates a throttle body which controls the speed of a motor, the motor operating only when electric power from said power source is supplied to the motor, an electric power control unit coupled between the electric power source and the motor operating to interactively cut electric power to the motor when the throttle body malfunctions, comprising:

a. a pressure sensitive switch (PSS) on the pedal connected between said electric power source and said motor, which is in the 'on' position when the pedal is being pressed and in an 'off' position when the pedal is not being pressed, the PSS causing electric power to flow to the motor when it is in the 'on' position, allowing the motor to operate when the pedal is being pressed;

b. a return switch (RS) on said throttle body, being in an 'on' position when the throttle body is in an idle position and in an 'off' position when the throttle body is in a position which is not the idle position, the RS providing electric power to the motor when in the 'on' position thereby allowing the motor to operate when the throttle body is in the idle position.

Another embodiment of the present invention may be a method of interactively correcting a malfunctioning throttle body and accelerator pedal which control the speed of a motor in a vehicle, the motor operating when it is supplied with electric power from a power source, the method comprising the steps of:

a. providing a pressure sensitive switch (PSS) on the pedal which is in the 'on' position when the pedal is being pressed and in an 'off' position when the pedal is not being pressed,
b. connecting the PSS between said electric power source and said motor, such that the PSS causes electric power to flow to the motor when it is in the 'on' position, thereby allowing the motor to operate when the pedal is being pressed;
c. connecting a return switch (RS) to said throttle body, such that it is in an 'on' position when the throttle body is in an idle position and in an 'off' position when the throttle body is in a position which is not the idle position,
d. connecting the RS to said power source and said motor such that the RS providing electric power to the motor when in the 'on' position thereby allowing the motor to operate when the throttle body is in the idle position.

It may also be embodied as a method of slowing a motor in a vehicle having an accelerator pedal which controls a throttle body which controls the motor, a power source, said motor which operates when provided power from the power source, comprising the steps of:

a. continuously sensing if the accelerator pedal is pressed;
b. continuously sensing if the throttle body is in a resting position or a running position;
c. restricting power from running from power source to the motor when the throttle body is in its running position and the accelerator pedal is not pressed indicating an error condition; and
d. applying power from power source to the motor when either the throttle body is in its resting position or the accelerator pedal is pressed indicating a normal condition.

OBJECTS OF THE INVENTION

It is another object of the present invention to provide a system which reduces the operation of a motor or engine of a vehicle if the throttle linkage sticks.

It is another object of the present invention to provide a safety system which intermittently slows or stops a motor or engine only during a throttle malfunction, however, quickly switches to normal operation when desired.

It is another object of the present invention to provide continuous, interactive reduction of a motor or engine of a vehicle which provides a measure of safety while not significantly reducing the functioning of the motor or engine.

It is an object of the present invention to provide a motor or engine safety cut-out system with automatic re-set.

It is an object of the present invention to provide a motor or engine safety cut-out system with automatic re-set which may be used in a racing setting.

BRIEF DESCRIPTION OF THE DRAWINGS

In order to describe the manner in which the advantages and features of the invention can be obtained, a more particular description of the invention will be provided by reference to specific embodiments which are illustrated in the appended figures. Understanding that these figures depict only typical embodiments of the invention and are not therefore to be considered to be limiting of its scope, the invention will be described and explained with additional specificity and detail. The advantages of this disclosure will become more apparent when read in connection with the drawings, wherein.

DETAILED DESCRIPTION OF THE INVENTION

Figure 1:
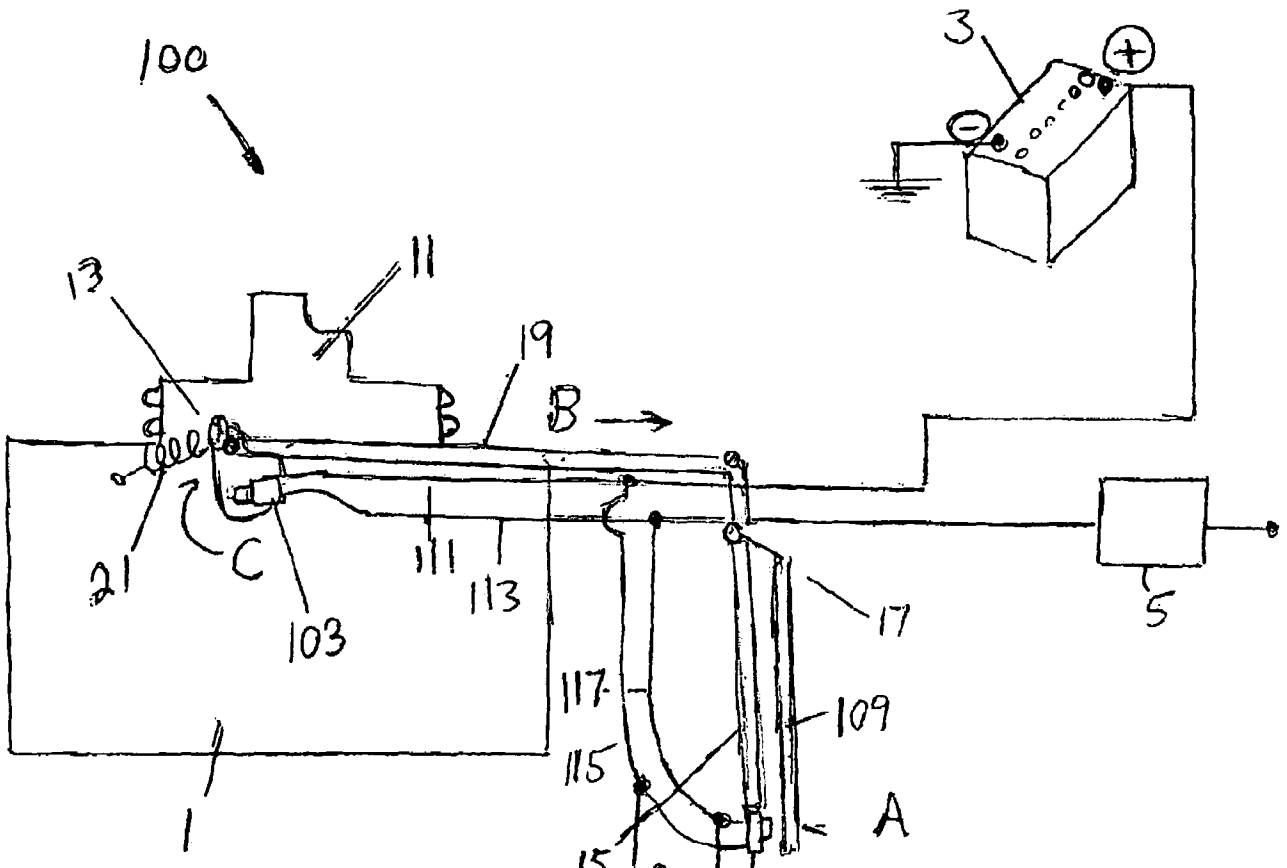
FIG. 1 is a perspective overall view of a continuous throttle regulation device according to one embodiment of the present invention.

FIG. 1 is a perspective partially schematic overall view of a continuous throttle regulation device according to one embodiment of the present invention.

In FIG. 1, the present invention is retrofitted to a motor 1 of a vehicle, in this embodiment being a gasoline engine with a carburetor 11 which controls the speed of the motor 1. Even though this example is explained for a gasoline engine, the invention applies equally to electric, gas, diesel, or hybrid motors and/or engines.

Carburetor 11 has a rotation plate 13 and linkage 19 which is connected to an internal throttle plate inside carburetor 11 which controls the flow of air into motor 1.

When a driver's foot presses pivoting accelerator pedal 15 in the direction of arrow A, pivoting accelerator pedal 15 pivots about pivot 17 causing rod 19 to move in the direction of arrow B, rotating rotation plate 13 in the direction marked by arrow C being a running position.

A return spring 21 urges rotation plate 13 and linkage 19 to rotate back in a direction opposite that of arrow C, returning linkage 19 back to a resting position.

During operation of vehicles, there have been times where the rotation plate 13 and linkage 19 sticks in an open position and is not returned to its resting position by return spring 21. Even if the rotation plate 13 and linkage 19 sticks for a short period of time, it may be enough to cause the driver to lose control of the vehicle and crash.

This problem is even more apparent when the drivers are racing at high speeds. In the last several years a number of professional drivers have been killed due to this phenomenon.

The present invention is designed to either retrofit existing vehicles, or can be built into newly constructed vehicles. A flap 109 is hinged over the pivoting accelerator pedal 15. A pressure sensitive switch (PSS) 105 is mounted under the flap 109. When the driver is pressing on the flap 109 and accelerator pedal 15, flap 109 and accelerator pedal 15 are said to be in their running position. When the driver is not pressing on flap 109 and accelerator pedal 15, these are said to be in their resting positions. In the resting position, PSS 105 is in an 'open' position, thereby restricting any power supplied to its input 115 from being passed to its output 117. However, when PSS is in its 'closed' position, it passes the power provided to its input 115 to its output 117.

When rotation plate 13 and linkage 19 are in their resting positions, it places a return switch (RS) 103 in its 'closed' position. With rotation plate 13 and linkage 19 in their resting positions, RS 103 conducts electricity, thereby causing power provided to its input 111 to be passed to its output 113. Conversely, when RS 103 is in its 'open' position, it does not pass power supplied to its input 111 to its output 113.

When a driver presses on the pivoting accelerator pedal 15 in the direction of arrow A, flap 109 pushes on PSS 105, thereby closing PSS 105.

As pivoting accelerator pedal 15 is pressed, rotation plate 13 rotates in the direction marked C away from the resting position, thereby opening RS 103 and causing linkage 19 to be moved.

The case where there is no pressure on accelerator pedal 15 and the rotation plate 13 and linkage 19 is in the resting position (PSS='open' and RS='closed) is a 'normal' condition, and the engine operates normally.

When there is pressure on accelerator pedal 15 and the linkage 13 is not in the resting position (PSS='closed' and RS='open') is also a normal condition, and the engine operates normally.

However, when the accelerator pedal 15 is not pressed and the linkage is not in the resting position (PSS='open' and RS='open') represents an error condition, such as a sticky rotation plate 13 and/or linkage 19, which is potentially harmful. In this case both PSS 105 and RS 103 are in the open position interrupting the flow of electrical power from vehicle power source 3 to vehicle motor 1 slowing or stopping motor.

In gasoline engines, one such way of accomplishing this is to restrict electric power from reaching an ignition circuit 5, thereby cutting off the power ultimately sent to spark plugs. This will immediately slow or stop the engine.

The power is cut off from the motor 1 until either the driver steps on accelerator pedal 15 or linkage 19 returns back to its resting position. In either such case, the motor automatically resumes normal operation.

It is possible that the linkage 19 may stick and free itself in a matter of seconds, or fractions of a second thereby causing the system to slow for a brief period of time. This would be enough to reduce the danger of the driver losing control of the vehicle, however not long enough to hurt performance during a race.

Since this system exhibits almost immediate response and immediate recovery, it may intermittently cut, or slow motor 1 many times as needed without significantly sacrificing power applied to drive the vehicle in a race. This allows the vehicle to still compete even though there is an intermittently sticky throttle.

Figure 2:
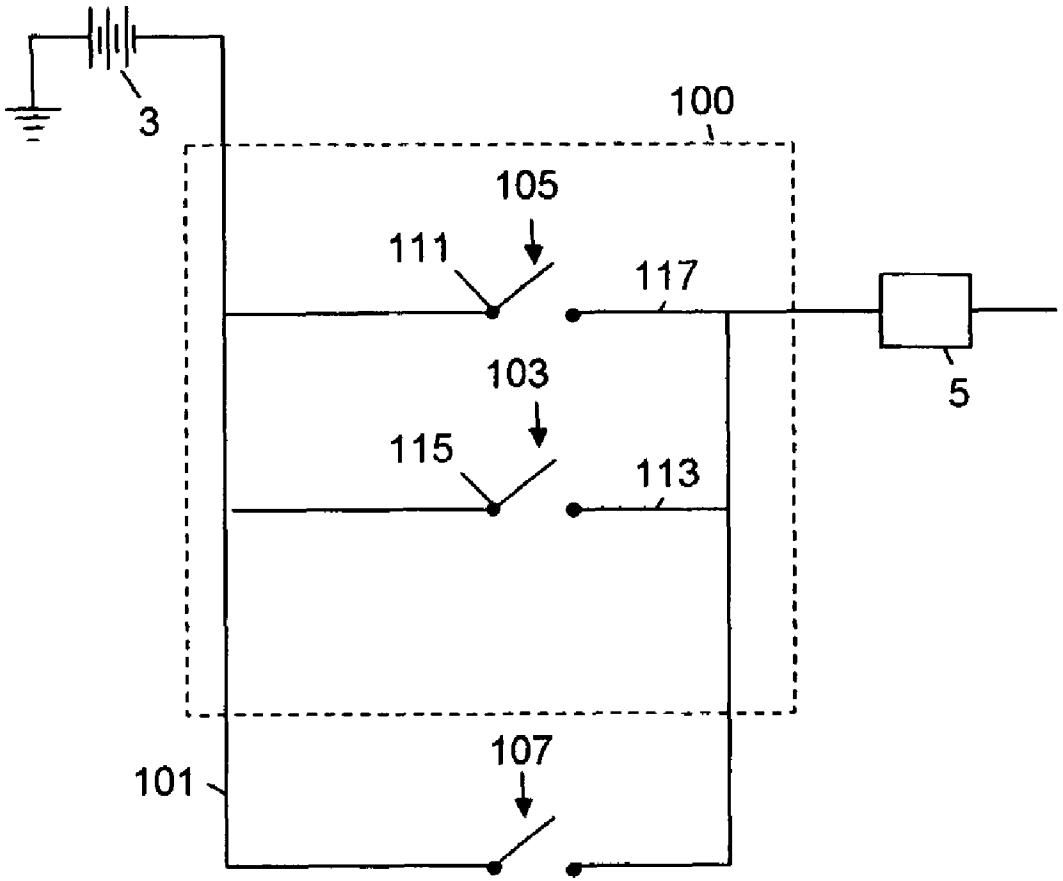
FIG. 2 is an enlarged schematic view of a portion of the device of FIG. 1.

FIG. 2 is an enlarged partial schematic view of the embodiment of FIG. 1. The vehicle's power source 3 provides power to the vehicle's ignition circuit 5 which provides energy to spark plugs (or powers an electric motor). The constant throttle regulation device 100 according to the present invention includes the parts as shown in FIG. 1.

Power from the positive terminal of power source 3 is provided to the inputs 111, 115 of RS 103 and PSS 105, respectively. In this embodiment, RS is shown here in its 'open' position indicating that the rotation plate 13 and linkage 19 is not in its resting position. Also, PSS is shown in its 'open' position indicating that the driver is not pressing on accelerator pedal 15. This is an error condition both switches are 'open' and power is cut/restricted from flowing from power source 3 to ignition circuit 5 of motor 1.

It should also be noted that an override switch 107 when open, causes the throttle regulation device 100 to be active and operational.

If override switch 107 is closed, power would then pass directly from the power source 3 to ignition circuit 5 via bypass circuit 101. Power would then be supplied to ignition circuit 5 regardless of the positions of RS 103 and PSS 105.

Since other modifications and changes varied to fit particular uses will be apparent to those skilled in the art, the invention is not considered limited to the example chosen for the purposes of disclosure, and covers all changes and modifications which do not constitute departures from the true spirit and scope of this invention as described in the appended claims.

It will be further appreciated by those skilled in the art that the figures and descriptions herein represent conceptual views embodying the principles of the invention. Similarly, it will be appreciated that other embodiments are covered whether or not explicitly shown here.

What is claimed is:

1. A safety control system in a vehicle having an electric power source and a motor for accelerating said vehicle, the motor having a throttle body which controls the speed of the motor, the motor only operating when electric power is provided to it, the safety control system comprising:

a. an accelerator pedal which operates a throttle body thereby controlling the speed of a motor;

b. a pressure sensitive switch (PSS) on the pedal connected between said electric power source and said motor, which is in the 'on' position when the pedal is being pressed and in an 'off' position when the pedal is not being pressed, the PSS causing electric power to flow to the motor when it is in the 'on' position, allowing the motor to operate when the pedal is being pressed;

c. a return switch (RS) on said throttle body, being in an 'on' position when the throttle body is in an idle position and in an 'off' position when the throttle body is in a position which is not the idle position, the RS providing electric power to the motor when in the 'on' position thereby allowing the motor to operate when the throttle body is in the idle position.

2. The safety control system of claim 1 wherein the motor is an internal combustion engine.

3. The safety control system of claim 1 wherein the motor is an electric motor.

4. The safety control system of claim 1, wherein the motor includes spark plugs, and the electric power is provided to a device which drives the spark plugs to operate the motor.

5. The safety control system of claim 1 wherein the motor is a diesel motor and the electric power is provided to an electronic fuel injection system.

6. In a vehicle having an electric power source and a motor for accelerating said vehicle, having accelerator pedal which operates a throttle body which controls the speed of a motor, the motor operating only when electric power from said power source is supplied to the motor, an electric power control unit coupled between the electric power source and the motor operating to interactively cut electric power to the motor when the throttle body malfunctions, comprising:

a. a pressure sensitive switch (PSS) on the pedal connected between said electric power source and said motor, which is in the 'on' position when the pedal is being pressed and in an 'off' position when the pedal is not being pressed, the PSS causing electric power to flow to the motor when it is in the 'on' position, allowing the motor to operate when the pedal is being pressed;

b. a return switch (RS) on said throttle body, being in an 'on' position when the throttle body is in an idle position and in an 'off' position when the throttle body is in a position which is not the idle position, the RS providing electric power to the motor when in the 'on' position thereby allowing the motor to operate when the throttle body is in the idle position.

7. The safety control system of claim 6 wherein the motor is an internal combustion engine.

8. The safety control system of claim 7 wherein the motor is an electric motor.

9. The safety control system of claim 8, wherein the motor includes spark plugs, and the electric power is provided to a device which drives the spark plugs to operate the motor.

10. A method of interactively correcting a malfunctioning throttle body and accelerator pedal which control the speed of a motor in a vehicle, the motor operating when it is supplied with electric power from a power source, the method comprising the steps of:

a. providing a pressure sensitive switch (PSS) on the pedal which is in the 'on' position when the pedal is being pressed and in an 'off' position when the pedal is not being pressed, b. connecting the PSS between said electric power source and said motor, such that the PSS causes electric power to flow to the motor when it is in the 'on' position, thereby allowing the motor to operate when the pedal is being pressed;

c. connecting a return switch (RS) to said throttle body, such that it is in an 'on' position when the throttle body is in an idle position and in an 'off' position when the throttle body is in a position which is not the idle position, d. connecting the RS to said power source and said motor such that the RS providing electric power to the motor when in the 'on' position thereby allowing the motor to operate when the throttle body is in the idle position.

11. The method of claim 10 wherein the motor is an internal combustion engine.

12. The method of claim 10 wherein the motor is an electric motor.

13. The method of claim 10, wherein the motor includes spark plugs and a device which drives the spark plugs when electric power is provided to it, and the step of connecting the RS to said power source and said motor comprises the step of:

connecting the RS to said power source electric power is provided to a said device for driving the spark plugs to operate the motor.

* * * * *